US009234380B2

(12) United States Patent
Hensley

(10) Patent No.: US 9,234,380 B2
(45) Date of Patent: Jan. 12, 2016

(54) THERMALLY INSULATING COMPOSITE FRAME APPARATUS WITH SLIDE-IN THERMAL ISOLATOR AND METHOD FOR MAKING SAME

(71) Applicant: Technoform Bautec North America, Inc., Twinsburg, OH (US)

(72) Inventor: Vincent Bart Hensley, Gate City, VA (US)

(73) Assignee: Technoform Bautec North America, Inc., Twinsburg, OH (US)

( * ) Notice: Subject to any disclaimer, the term of this patent is extended or adjusted under 35 U.S.C. 154(b) by 0 days.

(21) Appl. No.: 13/800,643

(22) Filed: Mar. 13, 2013

(65) Prior Publication Data

US 2014/0260064 A1 Sep. 18, 2014

(51) Int. Cl.

| | |
|---|---|
| ***E04B 2/00*** | (2006.01) |
| ***E04B 2/08*** | (2006.01) |
| ***E04C 2/38*** | (2006.01) |
| ***E06B 3/273*** | (2006.01) |
| ***E06B 3/263*** | (2006.01) |

(52) U.S. Cl.

CPC ..... *E06B 3/273* (2013.01); *E06B 3/26301* (2013.01); *E06B 2003/26314* (2013.01); *Y10T 29/49925* (2015.01)

(58) Field of Classification Search

CPC ..... F16B 5/0044; F16B 5/0052; F16B 5/002; E04B 1/6158; E04B 1/6145; Y10S 49/01

USPC ..... 52/590.1, 578, 580, 581, 588.1, 582.2, 52/584.1, 589.1, 590.2, 590.3, 591.1, 52/592.1

See application file for complete search history.

(56) References Cited

U.S. PATENT DOCUMENTS 2,863,185 A * 12/1958 Riedi ..... 403/297
3,603,053 A * 9/1971 Van Loghem et al. ..... 52/285.1

(Continued)

FOREIGN PATENT DOCUMENTS

EP 0085410 A3 1/1983
EP 0085410 B1 1/1983

(Continued)

OTHER PUBLICATIONS

Technoform Bautec Standard Profiles 2012—Catalog; 23 pages (2 per sheet), and front/back cover sheets.

(Continued)

*Primary Examiner* — Phi A
*Assistant Examiner* — Omar Hijaz
(74) *Attorney, Agent, or Firm* — Tucker Ellis LLP

(57) ABSTRACT

A composite frame member includes a pair of profile members extending in a longitudinal direction (Z) and held at connection regions thereof in a parallel, spaced apart relation by an insulating bridge member. The bridge member carries first and second head portions on opposite ends in a height direction (Y) wherein the head portions define outer planar surfaces and first and second inner planar surfaces. The first outer planar surface and the first and second inner planar surfaces of each head portion are mutually parallel and spaced apart in the height direction (Y). Opposed first and second flange members of each connection region are crimped inwardly and abut the outer planar surfaces and generate holding forces F exclusively in the height direction (Y) perpendicular to the longitudinal (Z) and transverse (X) directions.

19 Claims, 11 Drawing Sheets

(56) References Cited

U.S. PATENT DOCUMENTS

| | | | | | |
|---|---|---|---|---|---|
| 3,641,730 | A | * | 2/1972 | Meckstroth | 52/586.2 |
| 4,069,631 | A | * | 1/1978 | Nahr | 52/309.5 |
| 4,330,919 | A | | 5/1982 | Bischlipp et al. | |
| 4,461,133 | A | * | 7/1984 | Laroche | 52/204.593 |
| 5,022,205 | A | * | 6/1991 | Ford | 52/309.16 |
| 5,090,835 | A | * | 2/1992 | Cox | 403/294 |
| 5,363,628 | A | * | 11/1994 | Basar et al. | 52/745.19 |
| 5,391,436 | A | * | 2/1995 | Reid | 428/423.1 |
| 5,469,683 | A | * | 11/1995 | McKenna et al. | 52/204.591 |
| 5,554,713 | A | * | 9/1996 | Freeland | 528/76 |
| D384,271 | S | * | 9/1997 | Kozyrski | D8/382 |
| 5,727,356 | A | * | 3/1998 | Ensinger et al. | 52/717.02 |
| 5,934,039 | A | * | 8/1999 | Guy | 52/747.12 |
| 6,035,600 | A | | 3/2000 | Habicht et al. | |
| 6,036,398 | A | * | 3/2000 | Theodorou | 403/292 |
| 6,668,500 | B1 | * | 12/2003 | Lamberts | 52/204.72 |
| 7,065,929 | B2 | | 6/2006 | Manzella et al. | |
| 7,913,470 | B2 | | 3/2011 | Siodla et al. | |
| 8,001,743 | B2 | | 8/2011 | Lambertini | |
| 8,074,418 | B2 | * | 12/2011 | Thiagarajan et al. | 52/590.1 |
| 8,147,162 | B1 | * | 4/2012 | Burnett et al. | 403/292 |
| 2010/0115850 | A1 | | 5/2010 | Siodla et al. | |
| 2011/0318094 | A1 | | 12/2011 | Hensley | |

FOREIGN PATENT DOCUMENTS

| | | | |
|---|---|---|---|
| EP | 0085410 | B2 | 1/1983 |
| EP | 0085410 | | 10/1983 |
| WO | WO 84/03326 | | 8/1984 |
| WO | 2011012293 | | 2/2011 |
| WO | 2011020548 | | 2/2011 |
| WO | 2011050954 | | 5/2011 |

OTHER PUBLICATIONS

Profile #263800—Drawing Sheet; May 16, 2004.
Profile #958500—Drawing Sheet; Sep. 15, 1997.
International Search Report (2 pgs.) and Written Opinion (7 pgs.) for International Application No. PCT/US2014/020167 dated Jul. 18, 2014.

* cited by examiner

THERMALLY INSULATING COMPOSITE FRAME APPARATUS WITH SLIDE-IN THERMAL ISOLATOR AND METHOD FOR MAKING SAME

TECHNICAL FIELD

The embodiments herein relate generally to composite frame apparatus and components therefor. More specifically, the embodiments herein relate to thermally insulating composite frame apparatus and thermal insulating strip members for use in mounting windows, doors, curtain walls, storefront framing systems, panels, and in similar applications. In particular, the embodiments herein relate to an improved thermally insulating composite frame apparatus comprising spaced apart first and second elongated frame profile members structurally interconnected by a single thermally insulating bridge member.

BACKGROUND

Thermally insulating composite frame members for windows, curtain walls, storefront framing systems, and the like are known wherein elongated inner and outer metallic frame members are structurally interconnected by a thermal isolator formed of a plastic or other material. For example, U.S. Pat. No. 4,330,919 to Bischlipp discloses a connecting element which has two elongated profiled members bounding with one another in a channel wherein the two elongated profiled members are connected with at least two thermal separating members. The thermal separating members are formed by supplying a hardenable heat insulating material into the sections of the channel so as to harden and to form the heat insulating inserts separated from the intermediate hollow space by the bottom walls. The metallic profiled members together with the bottom walls form a unitary one-piece profiled element. In order to thermally isolate the metallic profiled members, a de-bridging operation is needed wherein a grinding tool is inserted into the intermediate hollow space for removal of selected portions of the profile material to separate the bottom walls from the remainder portions of the profiled members as well as to remove the same from the intermediate hollow space. De-bridging is a costly, dirty, and time consuming procedure.

U.S. Pat. No. 5,469,683 to McKenna discloses a thermally insulating composite frame member having a snap-in thermal isolator and which overcomes the need for a de-bridging operation wherein the snap-in thermal isolator is an elongated extrusion of generally H-shaped cross section. The complicated H-shape is necessary to hold the inner and outer frame members in alignment during assembly of the composite frame member. In this regard, the disclosed thermal isolator includes a pair of resilient, spaced apart legs projecting forward from an outwardly facing portion of the isolator. A second pair of resilient, spaced apart legs project rearward from an inwardly facing portion of the isolator. Each of the first and second pairs of spaced apart legs forms a jaw-like clamp configured to engage and to secure about a corresponding one of the facing flanges. In order to improve the shear force characteristics of the construction, the isolator of the disclosed embodiment is adhesively bonded to the gutter member and to the frame member in addition to the mechanical coupling provided by the jaw-like clamps of the isolator. Also in the disclosed embodiment mutually engaging surfaces of each of the jaw-like clamps and their respective flanges are knurled to provide further enhanced resistance to longitudinal shear forces.

SUMMARY

In accordance with an example embodiment, a composite frame apparatus comprises first and second elongate profile members extending in a direction along a longitudinal axis, a first connection region on the first profile member, a second connection region on the second profile member, and a bridge member supporting the first and second profile members in a spaced relationship. The first connection region comprises spaced apart first and second flange members defining a first landing region therebetween, the first and second flange members of the first connection region being selectively crimpable inwardly in a direction along a transverse axis, wherein the transverse axis is perpendicular to the longitudinal axis. The second connection region comprises spaced apart first and second flange members defining a second landing region therebetween, the first and second flange members of the second connection region being selectively crimpable inwardly in a direction along the transverse axis. The bridge member comprises a body portion and first and second head portions. The body portion extends in a direction along the longitudinal axis and has at least first and second longitudinal edges on opposite sides of the body portion in a direction along a height axis, wherein the height axis is perpendicular to the transverse and longitudinal axes. The first and second head portions are carried at the first and second longitudinal edges respectively. The first head portion defines a first outer planar surface and first and second inner planar surfaces, the first outer planar surface and the first and second inner planar surfaces being mutually parallel and spaced apart in a direction along the height axis, the first outer planar surface abuts the first landing region of the first connection region and the first and second inner planar surfaces abut the first and second flange members of the first connection region crimped inwardly. The second head portion defines a first outer planar surface and first and second inner planar surfaces, the first outer planar surface and the first and second inner planar surfaces being mutually parallel and spaced apart in a direction along the height axis, the first outer planar surface abuts the second landing region of the second connection region and the first and second inner planar surfaces abut the first and second flange members of the second connection region crimped inwardly.

In accordance with a further example embodiment, a thermal insulation strip is provided for connecting with an associated first profile member of an associated thermally insulating frame system comprising the first profile member and an associated profile member. The thermal insulation strip includes a body portion, a first head portion, and first and second foot members. The body portion extends along a longitudinal axis and has a central wall portion and first and second edges on opposite sides of the wall portion in a height axis perpendicular to the longitudinal axis. The first head portion is defined on the first edge of the body portion. The first and second foot members extend in opposite directions along a transverse axis from the first head portion, wherein the transverse axis is perpendicular to the longitudinal and height axes. The first and second foot members define an outer planar surface at a top end of the strip. The first and second foot members define an inner planar surface, the inner planar surface being parallel to the outer planar surface and being spaced apart from the outer planar surface by a thickness of the first and second foot members along the height axis.

In accordance with a still further example embodiment, a connection method comprises receiving a first head portion of a bridge member in a first connection region of a first elongate profile member extending in a direction along a longitudinal axis, locating a first outer planar surface of the bridge member in abutting contact with a first landing region of the first connection region, and crimping first and second flange members of the first connection region inwardly whereby a first planar clamping portion of the first flange member engages the first inner planar surface of the first head portion and a second planar clamping portion of the second flange member engages the second inner planar surface of the first head portion. In the embodiment, the first connection region comprises spaced apart first and second flange members defining a first landing region therebetween, the first and second flange members of the first connection region being selectively crimpable inwardly in a direction along a transverse axis, wherein the transverse axis is perpendicular to the longitudinal axis. Also in the embodiment, the bridge member comprises a body portion extending in a direction along the longitudinal axis and having at least a first longitudinal edge on an end of the body portion in a direction along a height axis, wherein the height axis is perpendicular to the transverse and longitudinal axes; a first head portion carried at the first longitudinal edge of the body portion, wherein the first head portion defines a first outer planar surface and first and second inner planar surfaces, the first outer planar surface and the first and second inner planar surfaces are mutually parallel and spaced apart in a direction along the height axis.

DETAILED DESCRIPTION OF THE EMBODIMENTS

Embodiments of the present teachings will be described in greater detail below with references to the Figures. The same features/elements are marked with the same reference numbers in all Figures. For the purpose of clarity, all reference numbers have not been inserted into all Figures. Also, not all views of the components have been shown in separate drawing Figures where the components are the same as or mirror images of components that are shown in one or more separate drawing Figures. In particular, however, for convenience of reference, components that are mirror images of, or mirror image equivalents of, components that are shown in one or more separate drawing Figures will be referred to herein and in the claims to follow using a prime (') suffix notation. The 3-dimensional (X, Y, Z) reference system shown in FIGS. 1-4 is applicable to all Figures and the description and the claims. The longitudinal directions correspond to the longitudinal (Z) axis, the traverse directions correspond to the transverse (X) axis, and the height directions correspond to the height (Y) axis.

Figure 1:
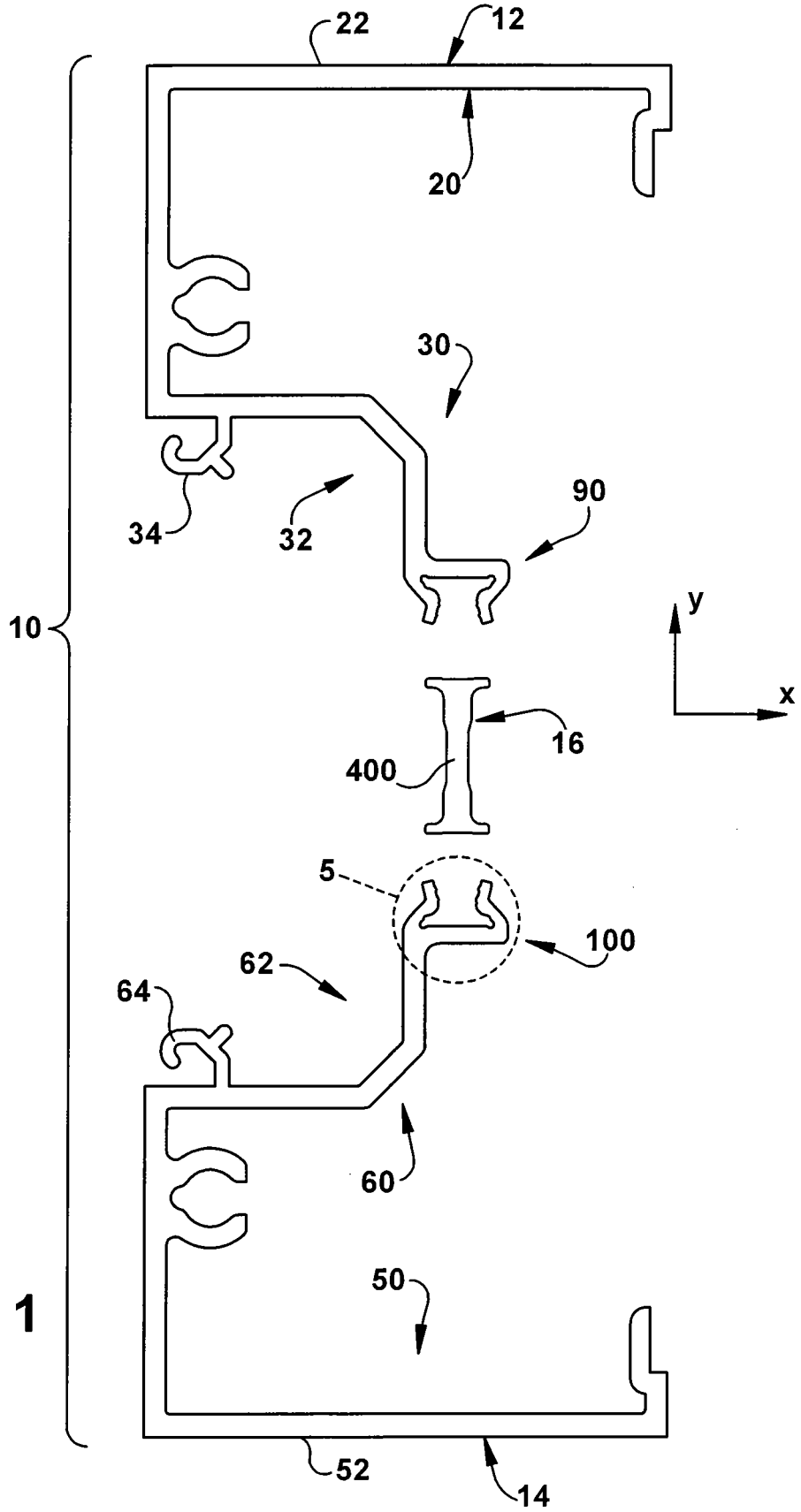
FIG. 1 is an exploded end view of a thermally insulating composite structural frame system according to an example embodiment.

Referring now to the drawings wherein the showings are for purposes of illustrating the example embodiments only and not for purposes of limiting same and in which like numerals indicate like elements throughout the several views. FIG. 1 depicts a thermally insulating frame assembly 10 including members embodying features of the example embodiments. The illustrated frame assembly 10 comprises a first elongate profile member 12, a second elongate profile member 14, and a bridge member 16, all of which may be initially pre-assembled in ways described herein and others to form the assembly 200 shown in FIG. 2 prior to one or more crimping or rolling steps and to form the completed or composite frame apparatus 300 shown in FIG. 3 after the one or more crimping or rolling steps wherein selected reglet or "hammer" portions of the profile members are cold worked for mechanical connection with the bridge member. In the example embodiments, the first and second profile members 12, 14 are made by an extrusion of an aluminum material and the bridge member 16 is formed of a plastic extrusion. One form of plastic found to be particularly well suited for use in building enclosure or envelope systems is polyamide such as, for example, polyamide known in the art as PA66 GF25 or the like. Other materials may be used for the profile and/or bridge members as necessary or desired for particular applications of the subject embodiments.

The first profile frame member 12 is an elongated aluminum extrusion of indeterminate length in the longitudinal direction along the longitudinal (Z) axis and comprises an outwardly facing portion 20 defining a substantially flat or planar surface 22, and an inwardly facing portion 30 carrying a connection portion 90. Similarly, the second profile frame member 14 is an elongate aluminum extrusion of indeterminate length in the longitudinal direction along the longitudinal (Z) axis and comprises an outwardly facing portion 50 defining a substantially flat or planar surface 52, and an inwardly facing portion 60 carrying a connection portion 100. For convenience and as a matter of convention, the first and second profile members 12, 14 have an overall length of about six (6) meters (19.68 feet). The outwardly facing planar surfaces 22, 52, of the first and second profile members 12, 14 are adapted for flat abutment against corresponding planar surfaces of associated structures such as, for example, building walls, ceilings, floors and other support surfaces or the like. As illustrated, the connection portions 90, 100 are carried on the ends of the inwardly facing portions 30, 60 of the first and second profile members 12, 14, respectively. However, it is to be appreciated that the connection portions 90, 100 can be connected or formed integrally with any region of the first and second profile members 12, 14 or connected with or formed integrally with any one or more structures other than the first and second profile members as necessary or desired.

Figure 2:
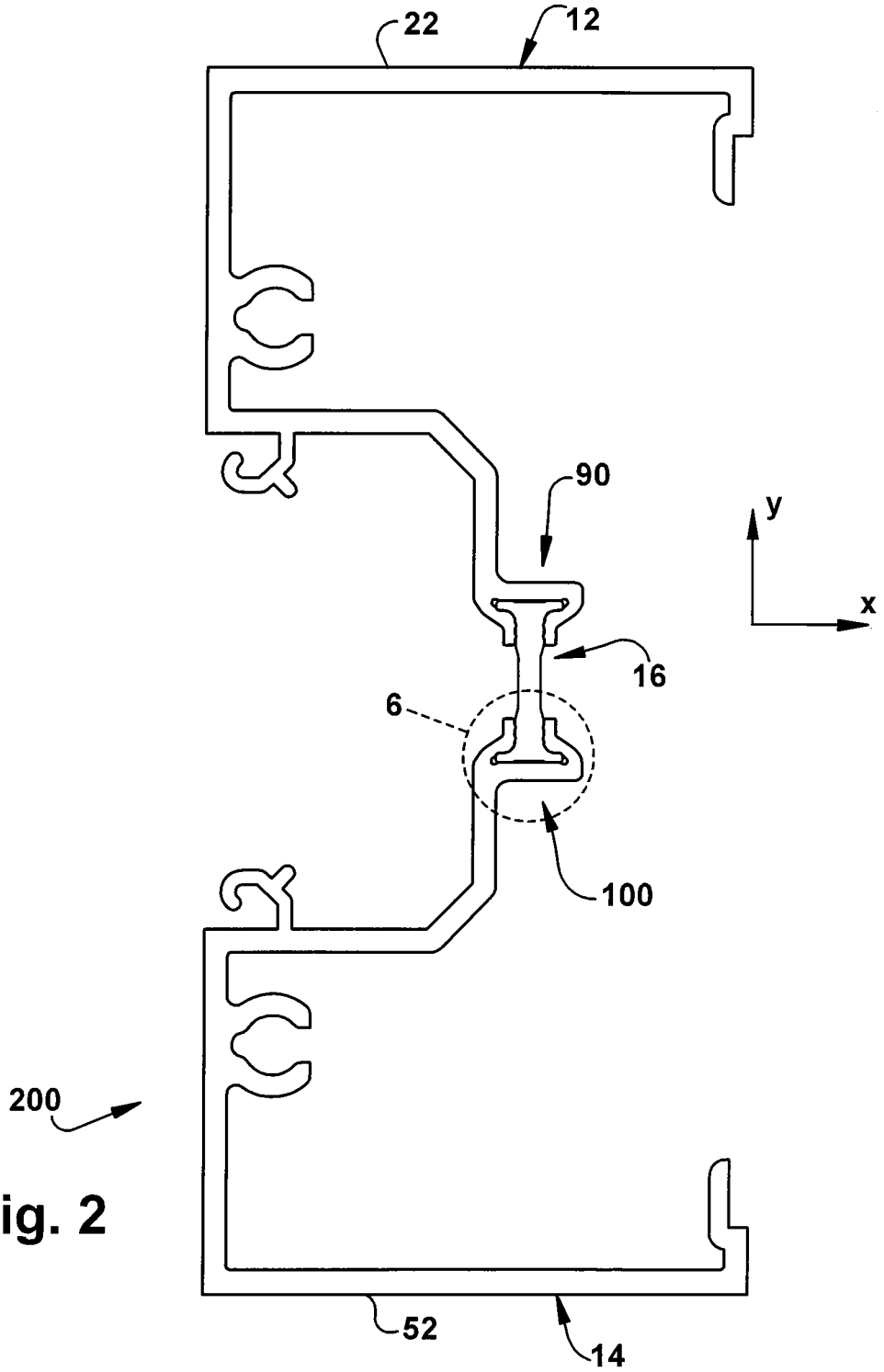
FIG. 2 is an end view of a thermally insulating composite structural frame apparatus according to an example embodiment formed by assembling and crimping selected portions of the system of FIG. 1.
Figure 3:
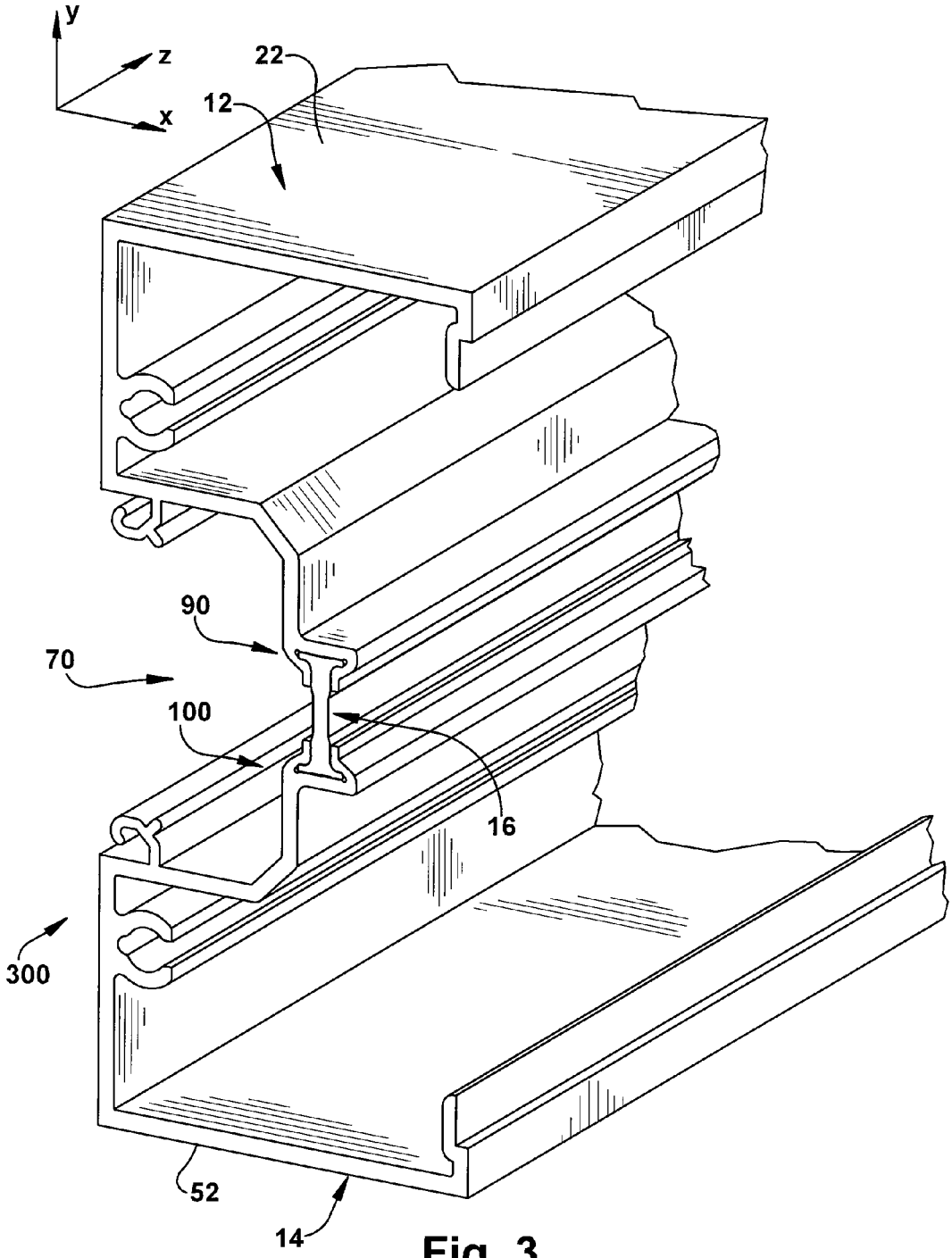
FIG. 3 is an isometric view of the thermally insulating composite structural frame apparatus of FIG. 2.

A partial concave region 32 of the inwardly facing portion 30 of the first profile member 12 carries a first hook member 34 and, similarly, a partial concave region 62 of the inwardly facing portion 60 of the second profile member 14 carries a second hook member 64. Collectively, the partial concave regions 32, 62 form a concave portion 70 of the composite apparatus 300 when the bridge member 16 is joined with the first and second profile members 12, 14 in their assembly and composite conformations such as shown in FIGS. 2 and 3, respectively. In general, the hook members 34, 64 adapt the thermally insulating composite frame apparatus 300 for connection with one or more associated gasket members (not shown) held thereby in a spaced apart relationship within the concave portion 70 whereby the edge of an associated window pane or any other building panel or the like may be selectively received and held there-between in a fluid tight and mechanically secure manner.

Figure 4:
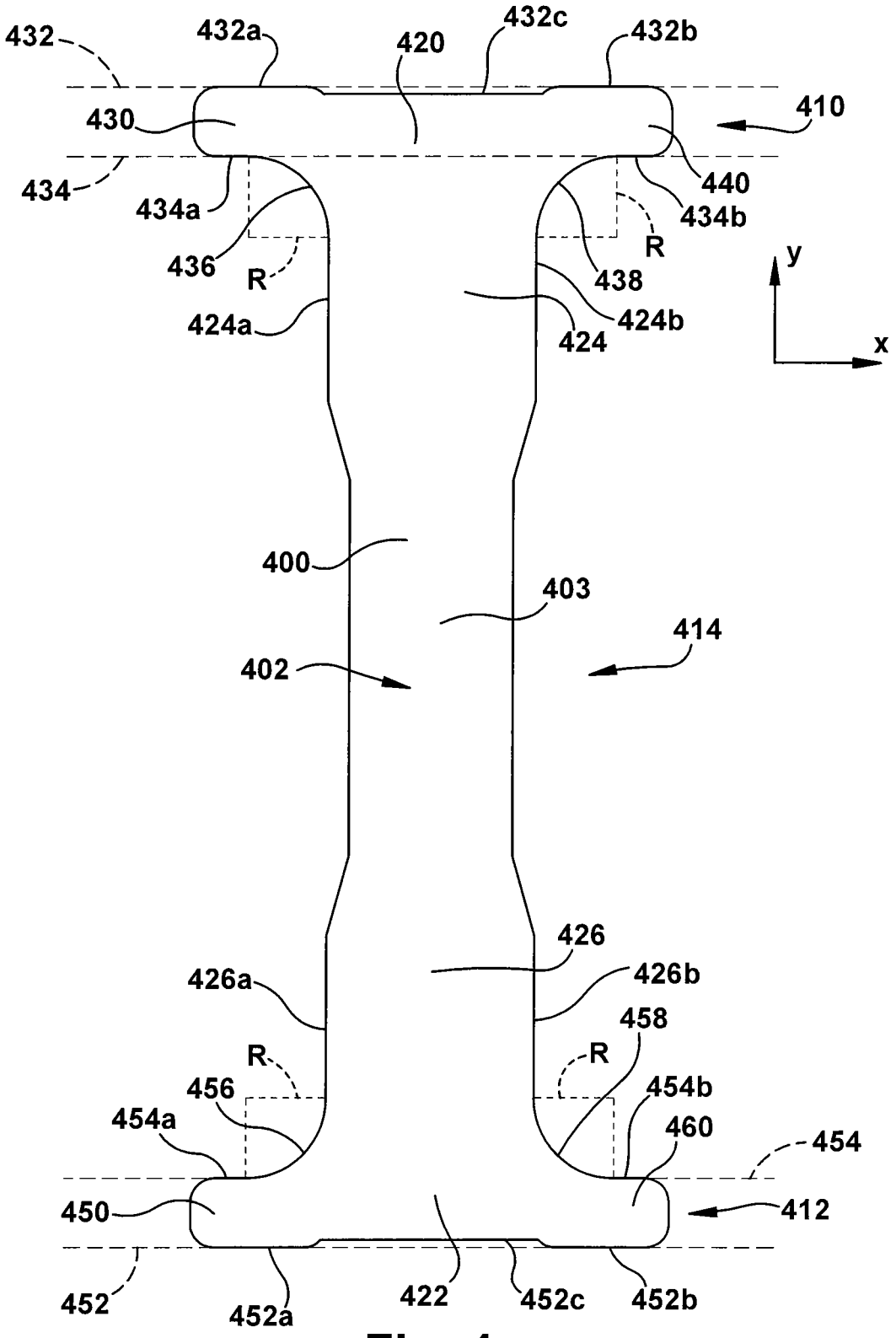
FIG. 4 is an enlarged end view of a thermal isolator bridge member of the composite structural frame apparatus depicted in FIGS. 1-3.

The bridge member 16 of the example embodiment is a thermally insulating strip member 400 shown in cross-section in FIG. 4 taken in a plane perpendicular to the longitudinal (Z) axis. The insulating strip member 400 preferably has a body portion 402 extending in a longitudinal direction (Z) formed as an elongated extrusion of generally I-shaped cross section, and includes at least two longitudinal edges 410, 412 separated by a selected distance in a height direction along the height (Y) axis by a central web or wall portion 414. The longitudinal edges 410, 412 are preferably configured or constructed for a shear-resistant connection along the longitudinal (Z) axis with profiled or shaped components of the respective frames or profiles 12, 14 in the connection portions 90, 100 for adapting the composite frame apparatus 300 for use in windows, doors, facades, building structures, and other architectural units or systems.

As will be appreciated, the thermally insulating strip member 400 maintains the inner and outer profiles or frames 12, 14 in a mechanically connected and spaced apart relationship. However, for creation of a thermal barrier between the first and second profiles 12, 14, the strip member 400 is made of a material exhibiting low thermal conductivity characteristics in order to substantially minimize heat transfer from a warm side to a cold side of the composite structure. Accordingly, the thermal strip member 400 of the example embodiment is comprised of plastic such as polyamide (PA) or for example polyamide filled with fiber such as, for example, 42% fiber, though other materials such as ABS, Hard-PVC, PA, PET, PPT, PA/PPE, ASA, PA66, etc., with or without fiber reinforcement such as, e.g. PA66 GF25, or foams made of thermosetting plastics, such as PU having an appropriate density, preferably foams of lower density (0.01 to 0.3 kg/l) are also suitable. In one embodiment the base material of the isolator 16 of the disclosed embodiment is ABS. A weatherable polymer such as acrylic styrene acrylonitrile, commercially available from GE Plastics under the designation Geloy, is optionally applied to lateral surfaces of the thermal isolator 16 to provide U.V. protection. In a further alternate embodiment, the lateral surfaces of the isolator bridge member 16 are coated with Geloy to provide U.V. protection. The surfaces of the enlarged head portions of the isolator bridge member 16 may be optionally coated with a flexible polyurethane to increase the shear strength.

As shown best in FIG. 4, the strip member 400 is, in the example embodiment, axisymmetric in both the transverse (X) and height (Y) directions. Further, since the strip member 400 of the example embodiment is an extruded member, it is also symmetric in the longitudinal (Z) direction as well. It is to be appreciated however, that symmetry of the strip member 400 in the height direction (Y) is not required or necessary for reasons that will become apparent in the descriptions to follow.

In the example embodiment, each of the longitudinal edges 410, 412 define enlarged first and second head portions 420, 422, respectively. In addition, the central web or wall portion 414 is coupled with the head portions 420, 422 by thicker crank or base regions 424, 426 of the strip member 400, respectively. As can be seen in the Figures, the crank regions 424, 426 are substantially thicker than the wall portion 414 to ensure the mechanical strength of the strip member 400. However, in order for the strip member 400 to more efficiently block the communication of thermal energy between the first and second profile members 12, 14, the central wall portion 414 has a reduced thickness relative to the crank regions 424, 426. The reduced thickness of the wall portion 414 also saves on material costs and weight of the overall composite frame apparatus 300. In example embodiments, the thickness of the crank regions 424, 426 is in the range of about 1.5-1.1 times the thickness of the wall portion 414. In the example embodiment illustrated, however, the thickness of the crank regions 424, 426 is about 1.3 times the thickness of the wall portion 414. However, the ratio of the thickness between the crank regions and the web portion can be selected as desired. In addition, although the strip member 400 of the example embodiment illustrated is of a solid extrusion construction, it is to be appreciated that for purposes of reducing weight, material costs, and thermal conductivity, and for other reasons such as to provide a shear-resistant connection of the two profiles or frames even when the respective profiles or frames are subjected to different temperature environments, portions of the strip in the web and/or crank regions may be perforated wherein openings may be provided as desired penetrating through one or more walls of the strip body spaced from each other in the transverse (X), height (Y), and/or longitudinal (Z) direction(s) of the strip body.

With continued reference to FIG. 4, the first head portion 420 comprises a pair of oppositely directed foot members 430, 440 and, similarly, the second head portion 422 comprises a corresponding pair of oppositely directed foot members 450, 460. A first outer planar surface 432 is defined at the top end of the strip member 400 in the height direction (Y) by the outer surface of the foot members 430, 440 of the first head portion 420. Similarly, the outer surface of the foot members 450, 460 of the second head portion 422 defines a second outer planar surface 452 at the bottom of the strip member 400 in the height direction (Y).

In the embodiment illustrated, the first outer planar surface 432 is comprised of spaced apart partial planar surfaces 432*a* and 432*b* separated by a recessed region 432*c*. Similarly, the second outer planar surface 452 of the second head portion 422 is comprised of spaced apart partial planar surfaces 452*a* and 452*b* separated by a recessed region 452*c*. Although the first and second outer planar surfaces 432, 452 may be formed as single contiguous surfaces, it has been found that the size and location of the recessed region 432*c* relative to the partial inner planar surfaces 434*a*, 434*b*, and of the recessed region 452*c* relative to the partial inner planar surfaces 454*a*, 454*b* provide advantages relative to alignment of the profile members during manufacture of the composite frame apparatus 300 (FIG. 3) as will be described below in greater detail. In general, however, it has been found to be desirable that neither of the partial inner planar surfaces 434*a*, 434*b* overlap the recessed region 432*c* in the transverse (X) direction. Similarly, neither of the partial inner planar surfaces 454*a*, 454*b* overlap the recessed region 452*c* in the transverse (X) direction.

The foot members 430, 440 of the first head portion 420 and the foot members 450, 460 of the second head portion 422 further advantageously define planar regions and curved regions for enabling easy manufacture of the subject composite frame apparatus and for providing superior shear strength and good dimensional tolerance characteristics of the apparatus. More particularly and with initial reference to the first head portion 420, the foot members 430, 440 collectively define an inner planar surface 434 wherein, in the example embodiment, the inner planar surface 434 is parallel to the first outer planar surface 432. As shown, the inner planar surface 434 is comprised of a pair of partial inner planar surfaces 434*a*, 434*b* defined by the foot members 430, 440, respectively and are arranged on opposite sides of the upper crank portion 424. In the embodiment, each of the first outer and inner planar surfaces 432, 434 extend lengthwise in the longitudinal direction (Z) and have a width dimension in the transverse direction (X).

With continued reference to the first head portion 420, a concave connection region 436 is defined between the partial inner planar surface 434*a* and the upper crank region 424 and, similarly, a further or complementary concave connection region 438 is defined between the partial inner planar surface 434*b* and the upper crank region 424. Continuous transitions are provided on both sides of each concave connection region 436, 438. In this regard, there is a continuous transition between the partial inner planar surface 434*a* and the concave connection region 436, and there is a continuous transition between the partial inner planar surface 434*b* and the concave connection region 438. Also, there is a continuous transition between the concave connection region 436 and the first side 424*a* of the wall portion 414, and there is a continuous transition between the concave connection region 438 and the second side 424*b* of the wall portion 414. In the example embodiment, each of the concave connection regions 436, 438 are semi-circular subtending an angle of about 90 degrees and each have a predefined radius R.

With reference next to the second head portion 422, the foot members 450, 460 collectively define a second inner planar surface 454 wherein, in the example embodiment, the second inner planar surface 454 is parallel to the second outer planar surface 452. As shown, the inner planar surface 454 is comprised of a pair of partial inner planar surfaces 454*a*, 454*b* defined by the foot members 450, 460, respectively and are arranged on opposite sides of the lower crank region 426. In the embodiment, each of the second outer and inner planar surfaces 452, 454 extend lengthwise in the longitudinal direction (Z) and have a width dimension in the transverse direction (X).

With continued reference to the second head portion 422 shown in FIG. 4, a concave connection region 456 is defined between the partial inner planar surface 454*a* and the lower crank region 426 and, similarly, a further or complementary concave connection region 458 is defined between the partial inner planar surfaces 454*b* and the lower crank region 426. Continuous transitions are provided on both sides of each concave connection region 456, 458. In this regard, there is a continuous transition between the partial inner planar surface 454*a* and the concave connection region 456, and there is a continuous transition between the partial inner planar surface 454*b* and the concave connection region 458. Also, there is a continuous transition between the concave connection region 456 and the first side 426*a* of the wall portion 414, and there is a continuous transition between the concave connection region 458 and the second side 426*b* of the wall portion 414. In the example embodiment, each of the concave connection regions 456, 458 are semi-circular subtending an angle of about 90 degrees and each have a predefined radius R. The partial inner planar surfaces 434*a*, 434*b*; 454*a*, 454*b*, extend continuous to the tip portions of the corresponding foot members 430, 440 in the transverse direction (X). Each of the tip portions of the foot members 430, 440; 450, 460 extends over less than 10%, preferably less than 5% of the total width of the corresponding first/second head portion 420; 430.

As shown in the drawing Figure, in the example embodiment, the inner planar surfaces 434*a* and 434*b* are completely overlapped in the transverse (X) axis by the outer planar surfaces 432*a* and 432*b*. Also as shown, in the example embodiment, none of the recessed region 432*c* overlaps the outer planar surfaces 432*a* and 432*b* in a direction along the transverse (X) axis. In that way, crimping forces to be described in greater detail below generated during manufacture or assembly of the subject composite frame apparatus are directed directly through the material forming the foot members 430, 440 without any intervening air gaps, free space or spaces void of material, thereby providing for a secure and highly efficient connection at the bottom end of the strip member 400 and also thereby helping to avoid any distortion or misalignment while crimping during manufacture.

Similarly, in the example embodiment, the inner planar surfaces 454*a* and 454*b* are completely overlapped in the transverse (X) axis by the outer planar surfaces 452*a* and 452*b*. Also as shown, in the example embodiment, none of the recessed region 452*c* overlaps the outer planar surfaces 452*a* and 452*b* in a direction along the transverse (X) axis. In that way, crimping forces to be described in greater detail below generated during manufacture or assembly of the subject composite frame apparatus are directed directly through the material forming the foot members 450, 460 without any intervening air gaps, free space or spaces void of material, thereby providing for a secure and highly efficient connection at the top end of the strip member 400 and also thereby helping to avoid any distortion or misalignment while crimping during manufacture.

Figure 5:
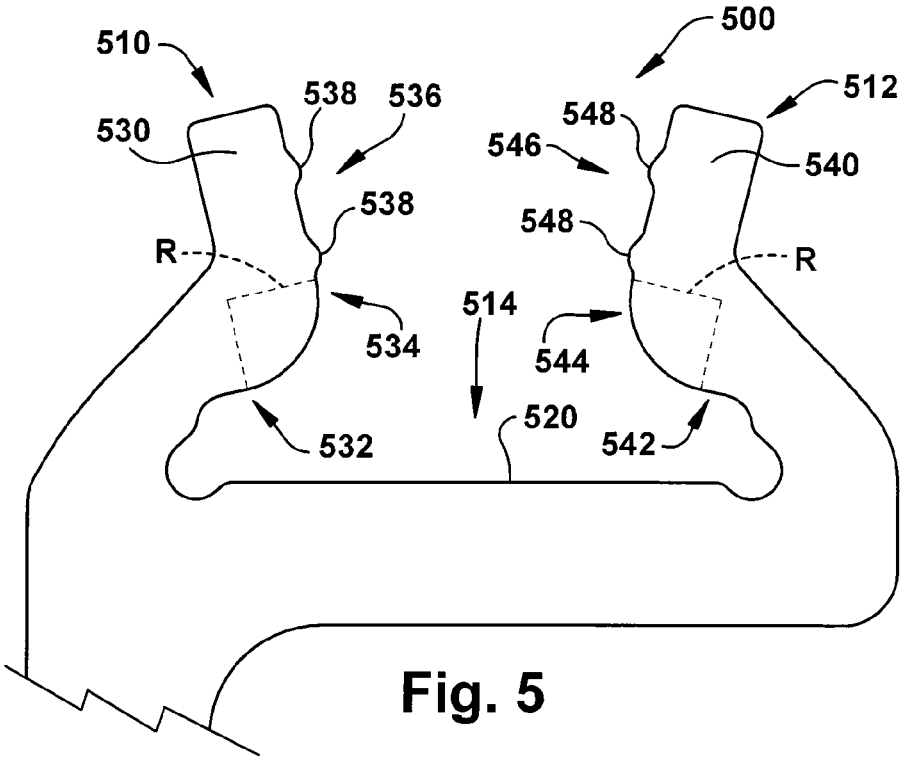
FIG. 5 is an enlarged end view of a reglet connector portion of a profile member of the composite structural frame apparatus depicted in FIGS. 1-3 and as identified at 5 in FIG. 1.

FIG. 5 illustrates the construction of connection region 500 comprising the connection portion 100 of FIG. 1 within the area 5 in the drawing. The connection region 500 includes a pair of spaced apart opposed flange members 510, 512 defining a landing region 514 therebetween. The landing region 514 defines a planar locating surface 520 configured to locate and support the head portion 422 of the strip member 400 such as shown for example in FIG. 11*a*. In accordance with the example embodiment, the planar locating surface 520 is sized and shaped to correspond with the size and shape of the outer planar surface 452 of the foot members 450, 460 of the second head portion 422. More particularly, the planar locating surface 520 is configured to receive the foot members 450, 460 and make abutting contact with the partial planar surfaces 452*a*, 452*b* so that the strip member is positively located relative to the second profile member 14. It is to be appreciated that the connection portion 90 shown in FIG. 1 has, essentially, the same construction as the connection region 500 described.

Figure 11A:
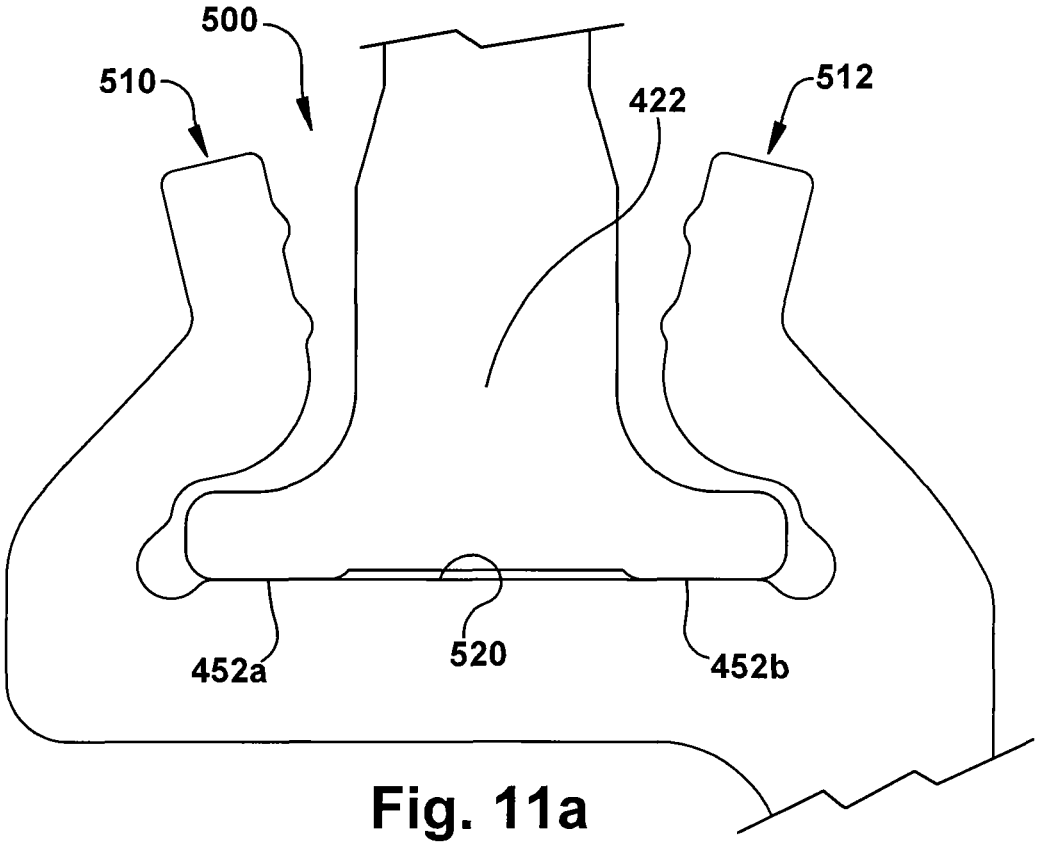
FIGS. 11*a*-11*c* are enlarged end views of the thermally insulating bridge member received in the reglet connector portion illustrating the stages of mechanical deformation of the reglet connector portion during the crimping steps of FIGS. 7 and 9.
Figure 11B:
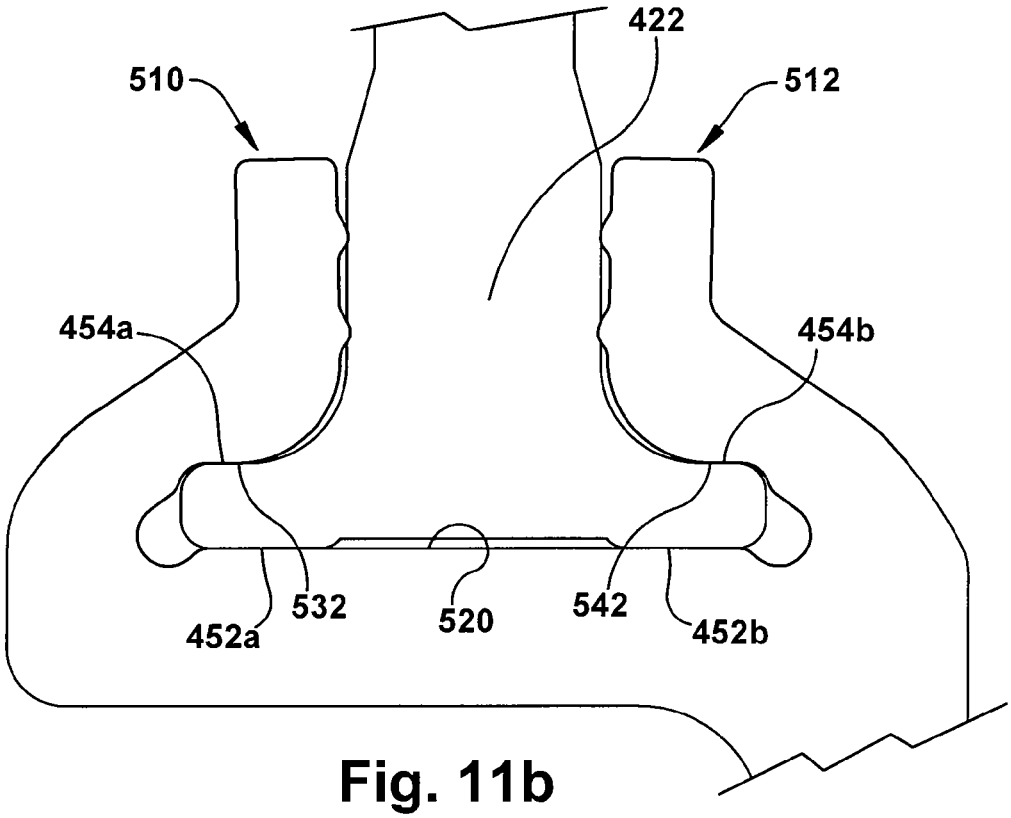
Figure 11C:
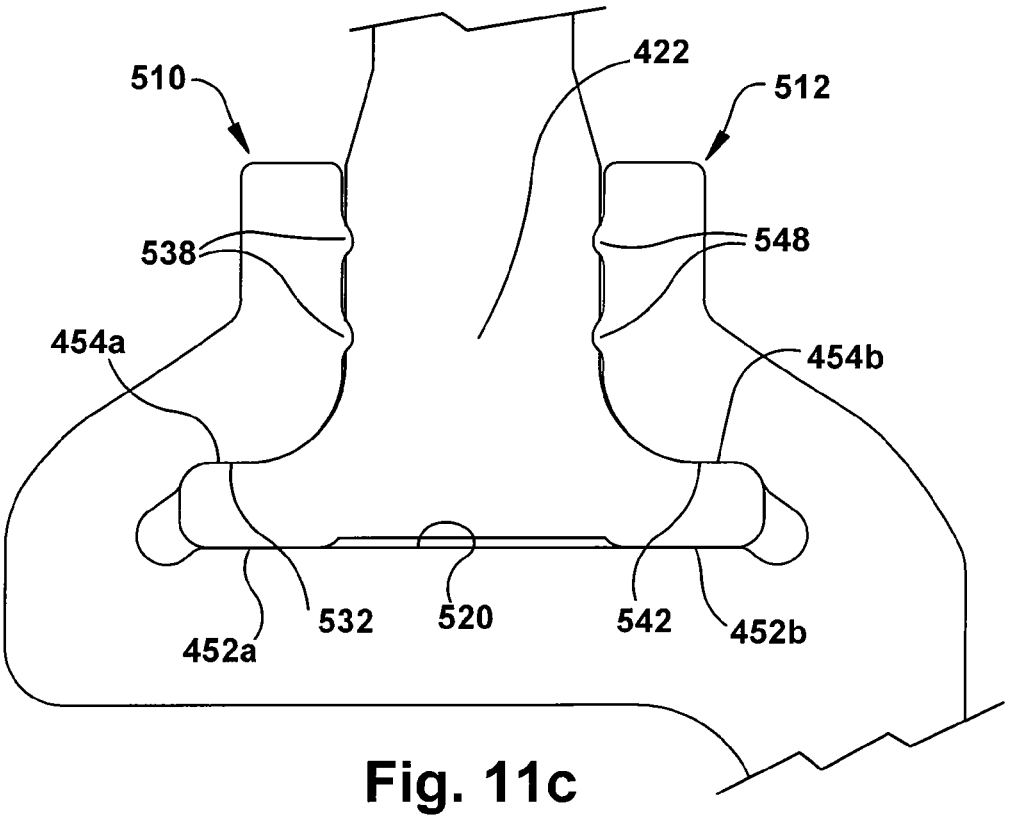

The first flange member 510 comprises an arm member 530 including a planar clamping region 532, a convex locating region 534, and a locking region 536. Similarly, the second flange member 512 comprises an arm member 540 including a planar clamping region 542, a convex locating region 544, and a locking region 546. Each of the "hammers" or flange members 510, 512 are formed of metal such as aluminum and are therefore configured to be moved such as by cold working or crimping between an opened orientation such as shown in FIGS. 1, 2, 5, and 11*a*, and a closed or crimped orientation such as shown in FIGS. 3 and 11*c*.

Figure 6:
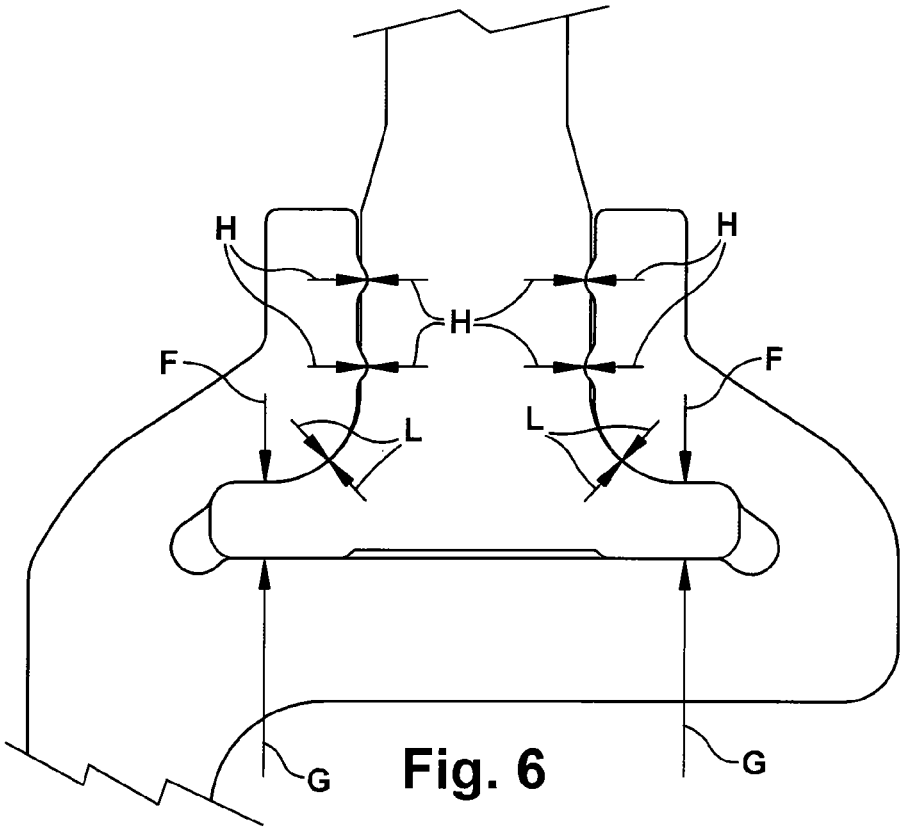
FIG. 6 is an enlarged end view of the thermal isolator member received in the reglet connector portion in a final assembled state of the profile member of the composite structural frame apparatus depicted in FIGS. 1-3 and as identified at 6 in FIG. 2.

In the example embodiment such as shown in FIG. 6, the planar clamping regions 532, 542 of the first and second arm members 530, 540 are configured in the closed or crimped orientations thereof to engage the partial inner planar surfaces 454*a*, 454*b* of the second head portion 422 of the strip member 400. More particularly, in the closed or crimped orientations the planar clamping regions 532, 542 of the first and second arm members 530, 540 are each configured to generate a locating and holding force F relative to the foot members 450, 460 in a direction exclusively normal or perpendicular to the planar locating surface 520. That is, in the example embodiment, the locating and holding force F has no component forces or contributions in the transverse (X) or longitudinal (Z) directions and is only directed in the height direction (Y). Correspondingly, the planar locating surface 520 generates substantially equal and opposite reactive forces G thereby effectively pinch holding the foot members securely in place between the planar clamping regions 532, 542 and the planar locating surface 520.

As shown in the Figure, none of the clamping force F is directed through the recessed region 452*c* (FIG. 4) but instead, in the example embodiment, exclusively through the overlapping inner and outer planar surfaces 454*a*, 452*a* and 454*b*, 452*b* thereby helping to ensure very accurate alignment of the components and final location thereof after the crimping step within a high tolerance.

Further in the example embodiment, the convex locating regions 534, 544 of the first and second arm members 530, 540 are configured in the closed or crimped orientations thereof to engage the concave connection regions 456, 458 of the second head portion 422 of the strip member 400. In the example embodiment, each of the convex locating regions 534, 544 correspond identically with the concave connection regions 456, 458 and are therefore semi-circular subtending an angle of about 90 degrees and have a predefined radius R. Mutual engagement of the convex locating regions 534, 544 with the concave connection regions 456, 458 results in superior sealing and shear strength properties of the strip member 400 relative to the profile members 12, 14 in the composite frame apparatus 300. Mutual opposite forces L are generated between the surfaces forming the convex locating regions 434, 544 and the concave connection regions 456, 458 for effectively aligning and locating the strip 400 relative to the respective profile member and securely holding the strip relative to the profile member.

For providing further sealing and shear strength properties of the strip member 400 relative to movement of the profile members 12, 14 along the longitudinal (Z) axis, the locking regions 536, 546 of each arm member 530, 540 carries on mutually facing portions of the arm members at least one ridge member 538, 548, respectively. As shown in FIG. 6, the ridge members 538, 548 penetrate into the crank region 424 of the second head portion 422 of the strip member when the arm members 530, 540 are moved to their closed or crimped as illustrated. In the example embodiment, the ridge members 538, 548 extend along the connection region 100 (in FIG. 1) in the longitudinal direction (Z). In a further embodiment, the ridge members 538, 548 are optionally provided with a toothed, roughened or knurled inner surface during manufacture thereof such as, for example, by use of a knurling tool (not shown) before the strip member 400 is received into the connection region 500 and prior to the cold working or crimping of the flange members 510, 512 onto the foot members 450, 460 of the head portion 422. The knurling tool may include for example plural spaced-apart radially extending ridges to simultaneously form a toothed or scribed surface together with the knurled inner surface on the ridge members 538, 548 during manufacture. In general, the knurled lateral surfaces of the selected areas increase surface area for enhanced mechanical bonding to further prevent longitudinal displacement of the profile frame members 12, 14 with respect to the thermal isolator 16 along the longitudinal (Z) axis in response to longitudinal shear forces. Mutual opposite forces H are generated between the components in the transverse (X) axis such as shown in the drawing Figure.

It is to be appreciated that for ease of discussion and description only the connection portion 100 is shown in an enlarged view in the drawing Figures as the connection portion 90 (FIG. 1) is, essentially a mirror image of the connection portion 100 described above. However, even though the connection regions 90, 100 are shown as having identical proportions, the embodiments herein are not so limited. Either one or both of the connection regions 90, 100 can be scaled as necessary or desired to fit or satisfy intended applications or the like. For purposes of completeness of description, the connection region 90 will now be described with reference to the connection region 100 shown in FIG. 5, but using a prime (') suffix for reference numbers having similar characteristics.

The connection region 90 includes a pair of spaced apart opposed flange members 510', 512' defining a landing region 514' therebetween. The landing region 514' defines a planar locating surface 520' configured to locate and support the head portion 420 of the strip member 400. In accordance with the example embodiment, the planar locating surface 520' is sized and shaped to correspond with the size and shape of the outer planar surface 432 of the foot members 430, 440 of the first head portion 420. More particularly, the planar locating surface 520' is configured to receive the foot members 430, 440 and make abutting contact with the partial planar surfaces 432*a*, 432*b* so that the strip member is positively located relative to the second profile member 14.

The first flange member 510' comprises an arm member 530' including a planar clamping region 532', a convex locating region 534', and a locking region 536'. Similarly, the second flange member 512' comprises an arm member 540' including a planar clamping region 542', a convex locating region 544', and a locking region 546'. Each of the flange members 510', 512' are formed of metal such as aluminum and are therefore configured to be moved such as by cold working or crimping between an opened orientation such as shown in FIGS. 1, 2, 5, and 11*a*, and a closed or crimped orientation such as shown in FIGS. 3 and 11*c*.

In a manner such as shown in FIG. 6, the planar clamping regions 532', 542' of the first and second arm members 530', 540' are configured in the closed or crimped orientations thereof to engage the partial inner planar surfaces 434*a*, 434*b* of the first head portion 420 of the strip member 400. More particularly, in the closed or crimped orientations the planar clamping regions 532', 542' of the first and second arm members 530', 540' are each configured to generate a locating and holding force F relative to the foot members 430, 440 in a direction exclusively normal or perpendicular to the planar locating surface 520'. That is, in the example embodiment, the locating and holding force F has no component forces or contributions in the transverse (X) or longitudinal (Z) directions and is only directed in the height direction (Y). Correspondingly, the planar locating surface 520' generates substantially equal and opposite reactive forces G thereby effectively pinch holding the foot members securely in place between the planar clamping regions 532', 542' and the planar locating surface 520'

It is to be appreciated that, in the example embodiment, none of the clamping force F is directed through the recessed region 432*c* (FIG. 4) but instead, in the example embodiment, exclusively through the overlapping inner and outer planar surfaces 434*a*, 432*a* and 434*b*, 432*b* thereby helping to ensure very accurate alignment of the components and final location thereof after the crimping step within a high tolerance.

Further in the example embodiment, the convex locating regions 534', 544' of the arm members 530', 540' are configured in the closed or crimped orientations thereof to engage the concave connection regions 436, 438 of the first head portion 424 of the strip member 400. In the example embodiment, each of the convex connection regions 532', 542' correspond identically with the concave connection regions 436, 438 and are therefore semi-circular subtending an angle of about 90 degrees and have a predefined radius R. Mutual engagement of the convex connection regions 532', 542' with the concave connection regions 436, 438 results in superior sealing and shear strength properties of the strip member 400 relative to the profile members 12, 14 in the composite frame apparatus 300.

For providing further sealing and shear strength properties of the strip member 400 relative to movement of the profile members 12, 14 along the longitudinal (Z) axis, the locking regions 536', 546' of each arm member 530', 540' carries on mutually facing portions of the arm members at least one ridge member 538', 548', respectively. The ridge members 538', 548' penetrate into the crank region 424 of the first head portion 420 of the strip member when the arm members 530', 540' are moved to their closed or crimped positions. In the example embodiment, the ridge members 538', 548' extend along the connection region 90 in the longitudinal direction (Z). In a further embodiment, the ridge members 538', 548' are optionally provided with a roughened or knurled inner surface during manufacture thereof such as by use of a knurling tool (not shown) before the strip member 400 is received into the connection region 500' and prior to the cold working or crimping of the flange members 510, 512 onto the foot members 430, 440 of the head portion 420. In general, the knurled lateral surfaces of the selected areas increase surface area for enhanced mechanical bonding to further prevent longitudinal displacement of the profile frame members 12, 14 with respect to the thermal isolator 16 along the longitudinal (Z) axis in response to longitudinal shear forces.

Figure 7:
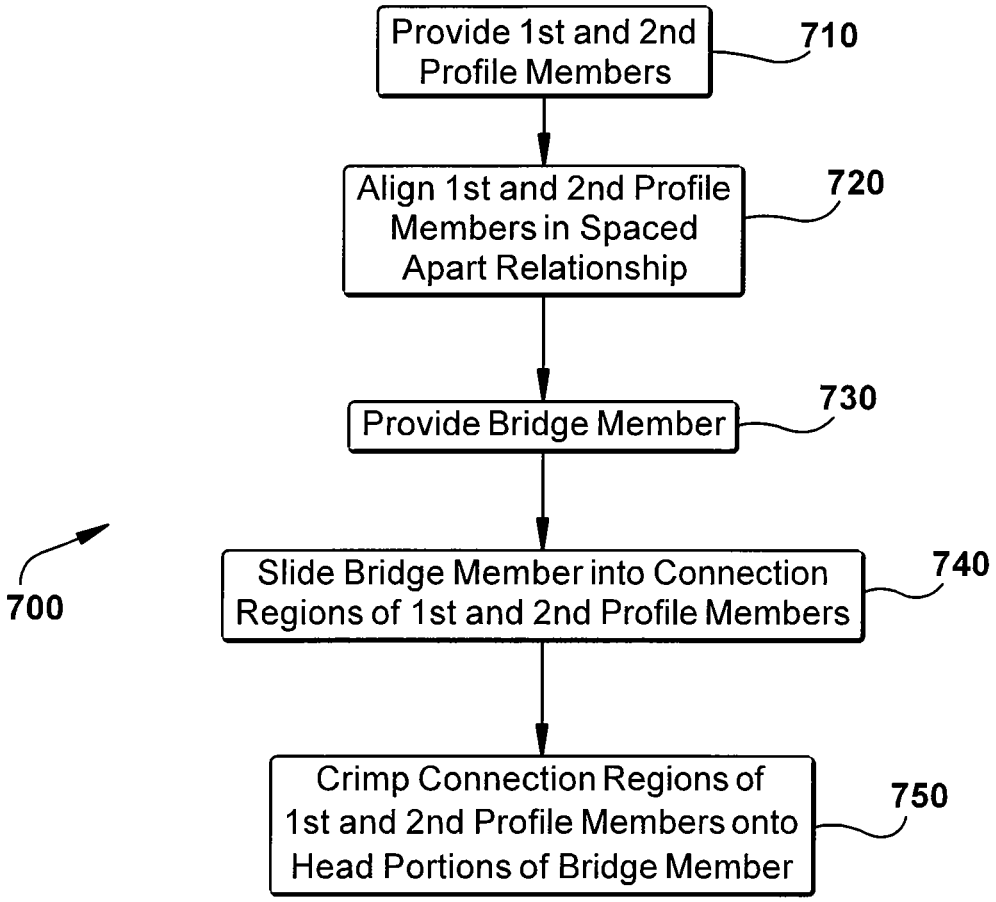
FIG. 7 is a flow chart illustrating a first method for manufacturing the composite structural frame apparatus depicted in FIGS. 1-3 in accordance with an example embodiment.
Figure 8C:
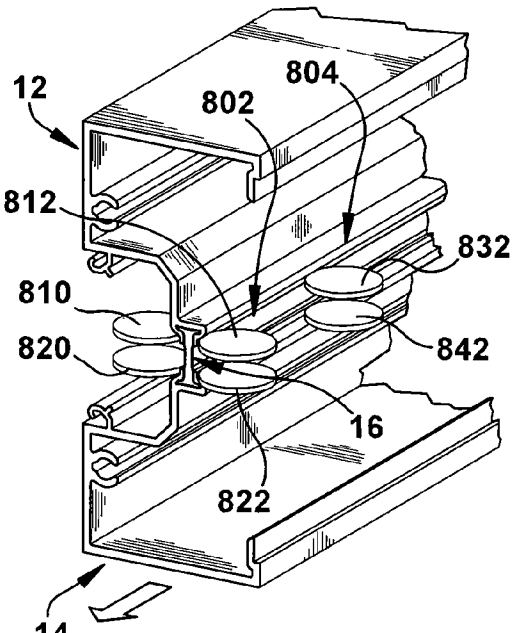
FIGS. 8*a*-8*c* are diagrammatic views of components of the composite structural frame apparatus depicted in FIGS. 1-3 during manufacture thereof in accordance with the method of FIG. 7.
Figure 8B:
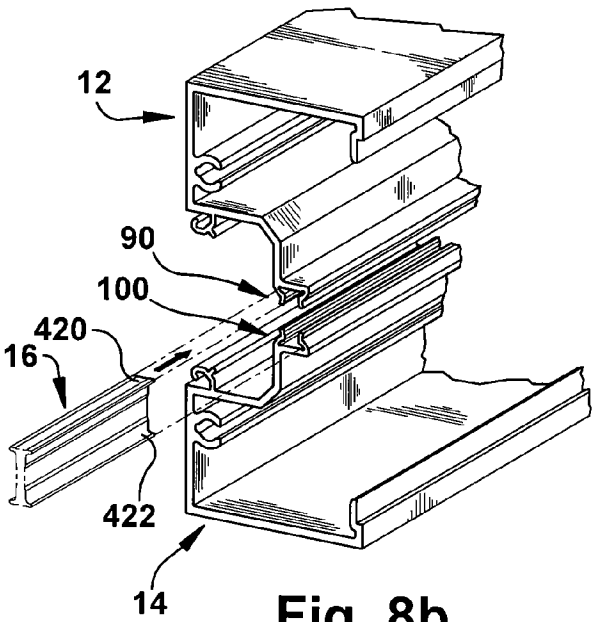
Figure 8A:
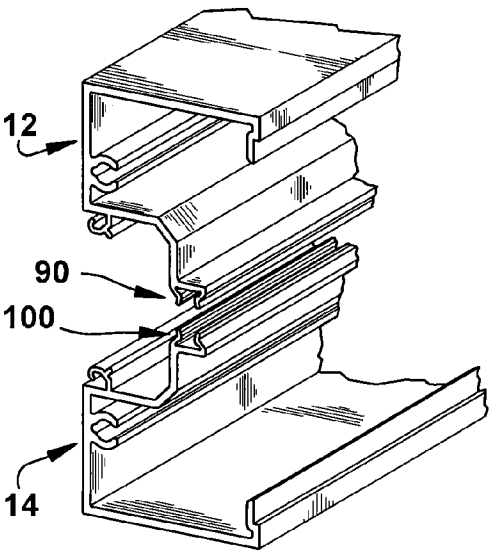

Assembly of the first profile member 12, the second profile member 14, and the thermal isolator bridge 16 to form the thermally insulating composite frame apparatus 300 (FIG. 3) is accomplished in accordance with an embodiment as shown in FIGS. 7, and 8*a*-8*c*. With reference now to those showings, in accordance with a first assembly method 700, first and second profile members 12, 14 are provided in step 710. At 720, the first and second profile members 12, 14 are aligned in a spaced apart relationship such as shown in FIG. 8*a* wherein the first and second profile members 12, 14 are oriented such that their respective connection regions 90, 100 are mutually directed. In addition, the profile members are aligned along the longitudinal direction (Z). The bridge member 16 is provided at step 730 and is inserted into the connection regions 90, 100 of the profile members 12, 14 at step 740. As shown in FIG. 8*b*, since the subject composite frame apparatus 300 needs no glue or any other additional or specialized bonding structures or agents to provide the superior shear strength, sealing and thermal properties obtained, the bridge member 16 is simply moved along the longitudinal direction (Z) so that the first head portion 420 is received into the first connection region 90 and the second head portion 422 is received into the second connection region 100. After the bridge member 16 is received into the connection regions 90, 100 of the profile members 12, 14 an assembly 200 (FIG. 2) is thereby formed wherein the profile members 12, 14 are loosely held together by the intervening bridge member 16. The assembly 200 can be handled during manufacture as semi-completed composite apparatus as necessary or desired such, as for example, relative to inventory, storage, handling or the like.

With continued reference to FIG. 7 the connection regions 90, 100 of the first and second profile members 12, 14 are crimped at step 750 onto the head portions 420, 422 of the bridge member. In the example embodiment, a two-step crimping process is used such as shown diagrammatically in FIG. 8*c* including a first crimping station 802 and a second crimping station 804. The first crimping station 802 comprises a set of upper crimping rollers 810, 812 for crimping the connection region 90 of the first profile member 12 onto the head portion 420 and a set of lower crimping rollers 820, 822 for crimping the connection region 100 of the second profile member 14 onto the second head portion 422. In the example embodiment, prior processing the assembly 200 through the first crimping station 802, the relative location and arrangement of the connection region 500 and the strip member 400 is as shown in FIG. 11*a*. As illustrated there, prior to the first crimping step the outer planar surfaces 452*a* and 452*b* of the second head portion 422 rest stably on the planar locating surface 520 of the connection region 500. Further in the example embodiment, after processing the assembly 200 through the first crimping station 802, the relative location and arrangement of the connection region 500 and the strip member 400 is as shown in FIG. 11*b*. As illustrated there, contact between the planar clamping regions 532, 542 of the flange members 510, 512 with the planar inner surfaces 454*a*, 454*b* occurs thereby urging the outer planar surfaces 452*a* and 452*b* of the second head portion 422 into tight contact against the planar locating surface 520 of the connection region 500 thereby substantially simultaneously aligning and fastening the strip member with the connection regions of the profile members. In the example embodiment, precise alignment between the components is enhanced by the overlapping surfaces wherein all of the area of the inner planar surfaces 454*a* and 454*b* is overlapped by the outer opanar surfaces 452*a* and 452*b*, respectively, in directions along the longitudinal axis (X). In the example embodiment, none of the inner planar surfaces 454*a* and 454*b* at the bottom of the strip member as viewed in FIG. 4 overlap the recessed region 452*c* in directions along the longitudinal axis (X). Similarly, in the example embodiment, none of the inner planar surfaces 434*a* and 434*b* at the top of the strip member as viewed in FIG. 4 overlap the recessed region 432*c* in directions along the longitudinal axis (X).

Further in the example embodiment, after processing the assembly 200 through the second crimping station 804 (FIGS. 8*a*-8*c*), the relative location and arrangement of the connection region 500 and the strip member 400 is as shown in FIG. 11*c*. As illustrated there, continued contact between the planar clamping regions 532, 542 of the flange members 510, 512 with the planar inner surfaces 454*a*, 454*b* occurs thereby further urging the outer planar surfaces 452*a* and 452*b* of the second head portion 422 into tight contact against the planar locating surface 520 of the connection region 500. In addition, the flange members 510, 512 are further crimped inwardly thereby urging the ridge members 538, 548 into intimate embedded contact with the head portion 422 substantially simultaneously with the continued aligning and fastening of the strip member with the connection regions of the profile members.

When thus assembled, engagement between the planar and curved surfaces of the connection region 500 with corresponding planar and curved surfaces of the head portion provides a mechanical interlock to prevent longitudinal displacement of the profile frame members 12, 14 with respect to the thermal isolator 16 in response to longitudinal shear forces.

Figure 9:
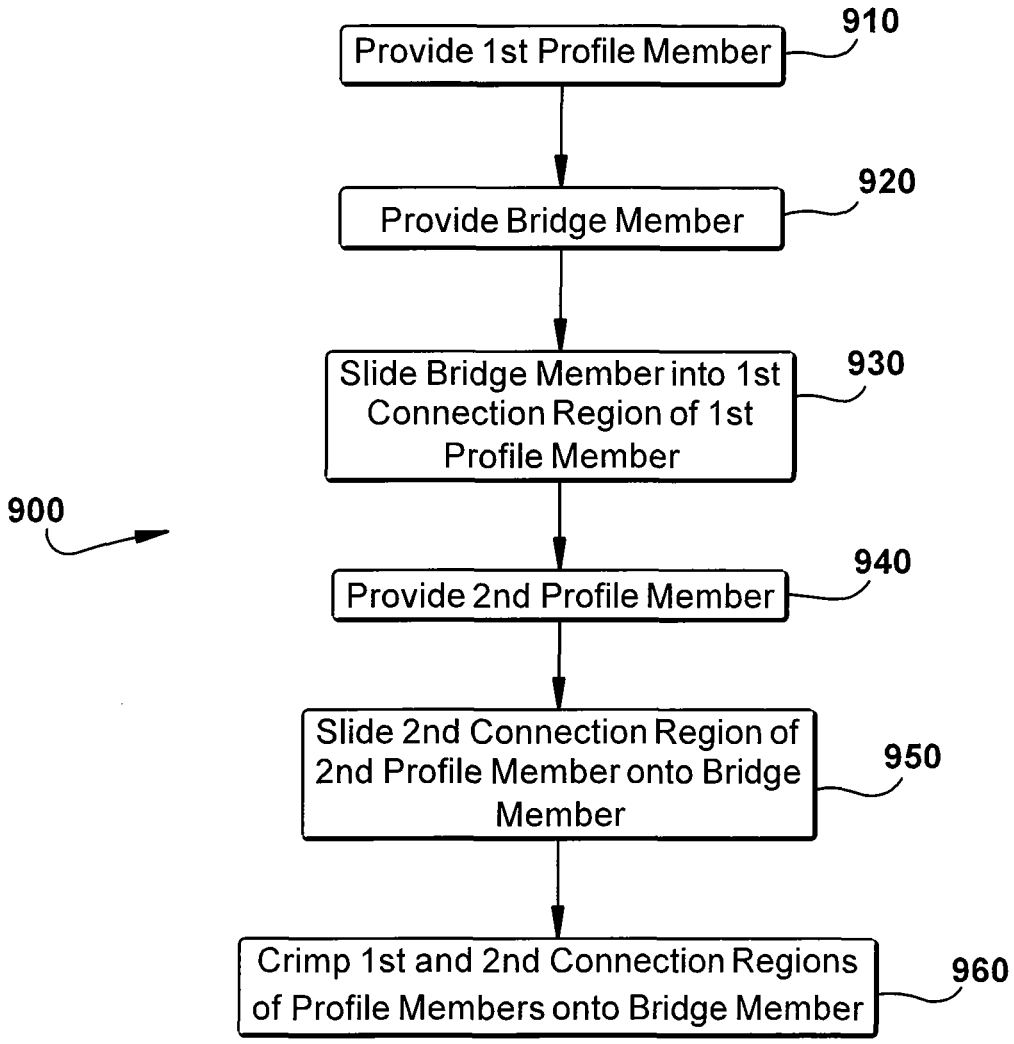
FIG. 9 is a flow chart illustrating a second method for manufacturing the composite structural frame apparatus depicted in FIGS. 1-3 in accordance with an example embodiment.
Figure 10C:
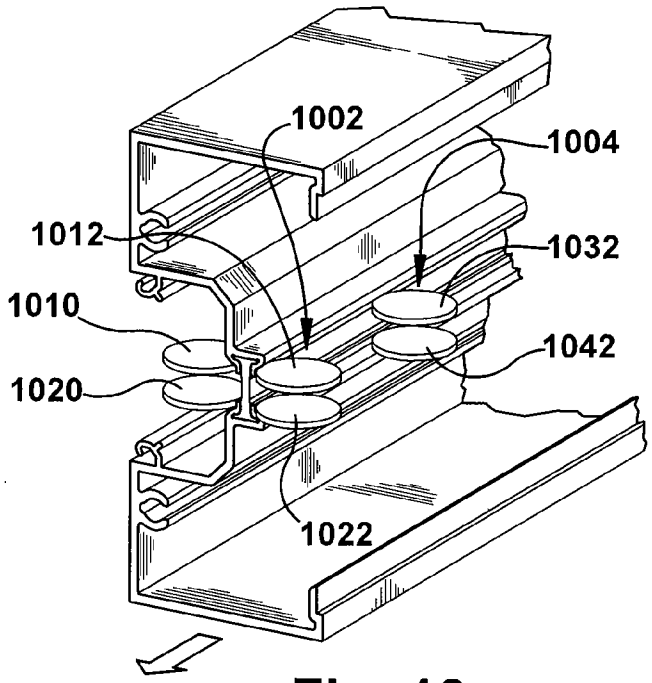
FIGS. 10*a*-10*c* are diagrammatic views of components of the composite structural frame apparatus depicted in FIGS. 1-3 during manufacture thereof in accordance with the method of FIG. 9.
Figure 10B:
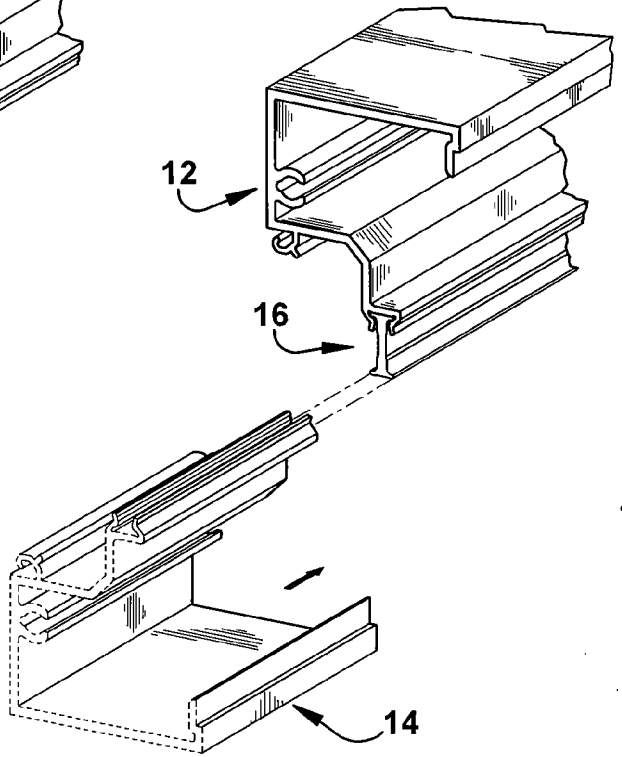
Figure 10A:
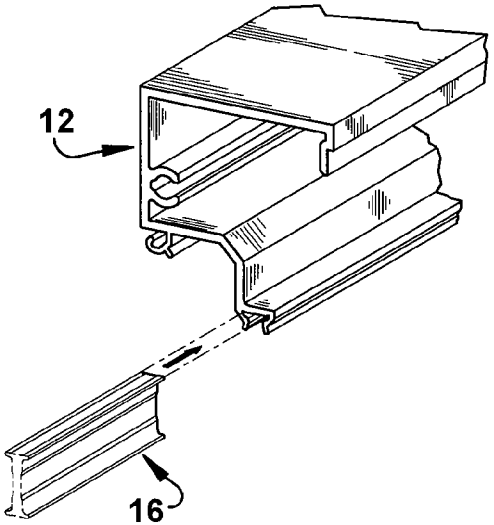

Assembly of the first profile member 12, the second profile member 14, and the thermal isolator bridge 16 to form the thermally insulating composite frame apparatus 300 (FIG. 3) is accomplished in accordance with a further embodiment as shown in FIGS. 9, and 10*a*-10*c*. With reference now to those showings, in accordance with a second assembly method 900, a first profile member 12 is provided in step 910. At 920 a bridge member is provided. At 930, the bridge member 16 is slid into the connection region 90 of the first profile member 12 such as illustrated for example in FIG. 10*a*. At 940 a second profile member 14 is provided. At 950, the second connection region 100 of the second profile member 14 is slid onto the bridge member 16 such as illustrated in FIG. 10*b*. Since the subject composite frame apparatus 300 needs no glue or any other additional or specialized bonding structures or agents to provide the superior shear strength, sealing and thermal properties obtained, the bridge member 16 is slidably movable within the connection regions of the profile members. After the bridge member 16 is received into the connection regions 90, 100 of the profile members 12, 14 an assembly 200 (FIG. 2) is thereby formed wherein the profile members 12, 14 are loosely held together by the intervening bridge member 16. The assembly 200 can be handled during manufacture as semi-completed composite apparatus as necessary or desired such as for example relative to inventory, storage, handling or the like.

With continued reference to FIG. 9 the connection regions 90, 100 of the first and second profile members 12, 14 are crimped at step 960 onto the head portions 420, 422 of the bridge member. In the example embodiment, a two-step crimping process is used such as shown diagrammatically in FIG. 10*c* including a first crimping station 1002 and a second crimping station 1004. The first crimping station 1002 comprises a set of upper crimping rollers 1010, 1012 for crimping the connection region 90 of the first profile member 12 onto the head portion 420 and a set of lower crimping rollers 1020, 1022 for crimping the connection region 100 of the second profile member 14 onto the second head portion 422. In the example embodiment, prior processing the assembly 200 through the first crimping station 1002, the relative location and arrangement of the connection region 500 and the strip member 400 is as shown in FIG. 11*a*. As illustrated there, prior to the first crimping step the outer planar surfaces 452*a* and 452*b* of the second head portion 422 rest stably on the planar locating surface 520 of the connection region 500. Further in the example embodiment, after processing the assembly 200 through the first crimping station 1002, the relative location and arrangement of the connection region 500 and the strip member 400 is as shown in FIG. 11*b*. As illustrated there, contact between the planar clamping regions 532, 542 of the flange members 510, 512 with the planar inner surfaces 454*a*, 454*b* occurs thereby urging the outer planar surfaces 452*a* and 452*b* of the second head portion 422 into tight contact against the planar locating surface 520 of the connection region 500 thereby substantially simultaneously aligning and fastening the strip member with the connection regions of the profile members.

Further in the example embodiment, after processing the assembly 200 through the second crimping station 1004, the relative location and arrangement of the connection region 500 and the strip member 400 is as shown in FIG. 11*c*. As illustrated there, continued contact between the planar clamping regions 532, 542 of the flange members 510, 512 with the planar inner surfaces 454*a*, 454*b* occurs thereby further urging the outer planar surfaces 452*a* and 452*b* of the second head portion 422 into tight contact against the planar locating surface 520 of the connection region 500. In addition, the flange members 510, 512 are further crimped inwardly thereby urging the ridge members 538, 548 into intimate embedded contact with the head portion 422 substantially simultaneously with the continued aligning and fastening of the strip member with the connection regions of the profile members.

When thus assembled, engagement between the planar and curved surfaces of the connection region 500 with corresponding planar and curved surfaces of the head portion provides a mechanical interlock to prevent longitudinal displacement of the profile frame members 12, 14 with respect to the thermal isolator 16 in response to longitudinal shear forces.

The preferred design of the strip member 400 having the first head portion 420 defining the first outer planar surface 432 and complementary foot portions 430, 440 defining the first and second inner planar surfaces 434*a*, 434*b* parallel to and spaced apart in a direction along the height (Y) axis from the first outer planar surface 432, and with the first and second concave connection portions 436, 438 in a continuous transition from the first and second inner planar surfaces 434*a*, 434*b* enables a self-centering connection with the corresponding complementary connection portion 90, 100 of the profile member 12, 14. The symmetric design allows, in cooperation with a correspondingly designed symmetric connection portion 90, 100, to apply a symmetric crimping process such that the simultaneous crimping (rolling in) of the flange members (hammers) 510, 512 avoids distortion of the resulting composite profile without having to apply additional measures/steps. Such distortions of the composite profiles are usually the result of the non-symmetric design of the connection portion of the profile member with fixed hammer and hammer to be deformed during the crimping (rolling). The non-symmetric design of the connection portion of the profile member results in a design of the heads of the strip member requiring slant abutment surfaces for the hammers pressing the strip member heads against the anvil and hammer.

While the preferred embodiments have been disclosed with respect to a window frame member, it will be appreciated that the design is easily adapted to doors, curtain walls, storefront framing systems, and many other frame applications in which a thermally insulating composite frame member would be advantageous.

Finally, it will be understood that the preferred embodiments have been disclosed by way of example, and that other modifications may occur to those skilled in the art without departing from the scope and spirit of the appended claims.

It is to be appreciated that each of the various features and teachings disclosed above may be utilized separately or in conjunction with other features and teachings to provide improved spacer profiles, and insulating window units and methods for designing, manufacturing and using the same. Representative examples of the present invention, which examples utilize many of these additional features and teachings both separately and in combination, were described above in detail with reference to the attached drawings. This detailed description is merely intended to teach a person of skill in the art further details for practicing preferred aspects of the present teachings and is not intended to limit the scope of the invention. Therefore, combinations of features and steps disclosed in the detailed description may not be necessary to practice the invention in the broadest sense, and are instead taught merely to particularly describe representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter.

The invention claimed is:

1. A composite frame apparatus comprising:

a first elongate profile member extending in a direction along a longitudinal axis;

a second elongate profile member extending in a direction along the longitudinal axis;

a first connection region on the first profile member, the first connection region comprising spaced apart first and second flange members defining a first landing region therebetween, the first landing region comprising a first substantially planar locating surface, the first and second flange members of the first connection region being selectively crimpable inwardly in a direction along a transverse axis, wherein the transverse axis is perpendicular to the longitudinal axis;

a second connection region on the second profile member, the second connection region comprising spaced apart first and second flange members defining a second landing region therebetween, the second landing region comprising a second substantially planar locating surface, the first and second flange members of the second connection region being selectively crimpable inwardly in a direction along the transverse axis; and a bridge member supporting the first and second profile members in a spaced relationship, the bridge member comprising:

a body portion extending in a direction along the longitudinal axis and having at least first and second longitudinal edges on opposite sides of the body portion in a direction along a height axis, wherein the height axis is perpendicular to the transverse and longitudinal axes;

first and second head portions carried at the first and second longitudinal edges, respectively;

the first head portion defining a first outer planar surface, a recessed region defined between ends of the first outer planar surface, and first and second inner planar surfaces, the first outer planar surface of the first head portion and the first and second inner planar surfaces of the first head portion being mutually, parallel and spaced apart in a direction along the height axis, the first outer planar surface of the first head portion being in abutting contact with the first substantially planar locating surface, the recessed region of the first head portion being spaced apart from the first substantially planar locating surface, and the first and second inner planar surfaces of the first head portion engaging the first and second flange members of the first connection region crimped inwardly; and, the second head portion defining a first outer planar surface, a recessed region defined between ends of the first outer planar surface, and first and second inner planar surfaces, the first outer planar surface of the second head portion and the first and second inner planar surfaces of the second head portion being mutually parallel and spaced apart in a direction along the height axis, the first outer planar surface of the second head portion being in abutting contact with the second substantially planar locating surface, the recessed region of the second head portion being spaced apart from the second substantially planar locating surface, and the first and second inner planar surfaces of the second head portion engaging the first and second flange members of the second connection region crimped inwardly.

2. The composite frame apparatus according to claim 1, wherein:

the first and second flange members of the first connection region are crimped inwardly and are in abutting contact with the first and second inner planar surfaces of the first head portion to generate holding forces F' in the first head portion exclusively in a direction along the height axis perpendicular to the longitudinal and transverse axes; and, the first and second flange members of the second connection region are crimped inwardly and are in abutting contact with the first and second inner planar surfaces of the second head portion to generate holding forces F in the second head portion exclusively in the direction along the height axis perpendicular to the longitudinal and transverse axes.

3. A composite frame apparatus comprising:

a first elongate profile member extending in a direction along a longitudinal axis;

a first connection region on the first profile member, the first connection region comprising spaced apart first and second flange members defining a first landing region therebetween, the first landing region comprising a first substantially planar locating surface, the first and second flange members of the first connection region being selectively crimpable inwardly in a direction along a transverse axis, wherein the transverse axis is perpendicular to the longitudinal axis; and a bridge member connected with the first profile member, the bridge member comprising:

a body portion extending in a direction along the longitudinal axis and having at least a first longitudinal edge on an end of the body portion in a direction along a height axis, wherein the height axis is perpendicular to the transverse and longitudinal axes; and a first head portion carried at the first longitudinal edge of the body portion, the first head portion defining a first outer planar surface, a recessed region defined in the first outer planar surface, and first and second inner planar surfaces, the first outer planar surface and the first and second inner planar surfaces being mutually parallel and spaced apart in a direction along the height axis, the first outer planar surface being in abutting contact with the first substantially planar locating surface, the recessed region being spaced apart from the first substantially planar locating surface, and the first and second inner planar surfaces engaging the first and second flange members of the first connection region crimped inwardly.

4. The composite frame apparatus according to claim 3, wherein:

the first and second flange members of the first connection region are crimped inwardly and are in abutting contact with the first and second inner planar surfaces of the first head portion to generate holding forces F' in the first head portion exclusively in a direction along the height axis perpendicular to the longitudinal and transverse axes.

5. The composite frame apparatus according to claim 4, wherein the bridge member comprises:

a first concave connection region defined between the first inner planar surface and the body portion; and, a second concave connection region defined between the second inner planar surface and the body portion.

6. The composite frame apparatus according to claim 5, wherein:

the first concave connection region is semi-circular and has a radius; and, the second concave connection region is semi-circular and has the same radius as the first concave connection region.

7. The composite frame apparatus according to claim 6, wherein:

the first concave connection region subtends an angle of about 90°; and, the second concave connection region subtends an angle of about 90°.

8. A thermal insulation strip for connecting with an associated thermally insulating frame system comprising a first profile member, the theuiial insulation strip comprising:

a body portion extending along a longitudinal axis and having a central wall portion and first and second edges on opposite sides of the wall portion in a height axis perpendicular to the longitudinal axis;

a first head portion defined on the first edge of the body portion;

first and second foot members extending in opposite directions along a transverse axis from the first head portion, wherein the transverse axis (X) is perpendicular to the longitudinal and height axes, wherein the first and second foot members define a first outer planar surface at a top end of the strip, wherein the first and second foot members define a first inner planar surface, the first inner planar surface being parallel to the first outer planar surface and being spaced apart from the first outer planar surface by a thickness of the first and second foot members along the height axis;

a first concave connection region defined between the body portion of the thermal insulation strip and a first partial inner planar surface defined by the first inner planar surface of the first foot member on a first side of the first head portion, wherein the first concave connection region is semi-circular having a first radius configured for mutual engagement with a corresponding convex portion of the associated first profile member of the associated thermally insulating frame system for aligning and locating the thermal insulation strip with the associated first profile member; and a second concave connection region defined between the body portion of the thermal insulation strip and a second partial inner planar surface defined by the first inner planar surface of the second foot member on a second side of the first head portion opposite from the first side of the first head portion, wherein the second concave connection region is semi-circular having a second radius configured for mutual engagement with a corresponding convex portion of the associated first profile member of the associated thermally insulating frame system for aligning and locating the thermal insulation strip with the associated first profile member;

wherein the first head portion defines a recessed region on the first edge of the body portion between spaced apart first and second outer planar surfaces, the recessed region terminating in the thickness of the first and second foot members along the height axis.

9. The thermal insulation strip according to claim 8, wherein:

the first radius of the first concave connection region is the same as the second radius of the second concave connection region.

10. The thermal insulation strip according to claim 9, wherein:

the first concave connection region subtends an angle of about 90°; and, the second concave connection region subtends an angle of about 90°.

11. The thermal insulation strip according to claim 8, further comprising:

a second head portion defined on the second edge of the body portion; and, third and fourth foot members extending in opposite directions along the transverse axis from the second head portion;

wherein the third and fourth foot members define a second outer planar surface at a bottom end of the strip; and, wherein the third and fourth foot members define a second inner planar surface, the second inner planar surface being parallel to the second outer planar surface and being spaced apart from the second outer planar surface by a thickness of the third and fourth foot members along the height axis.

12. The thermal insulation strip according to claim 11, wherein:

the third foot member defines a third partial inner planar surface of the second inner planar surface on a first side of the second head portion; and, the fourth foot member defines a fourth partial inner planar surface of the second inner planar surface on a second side of the second head portion opposite from the first side of the second head portion.

13. The thermal insulation strip according to claim 12, further comprising:

a third concave connection region defined between the third partial inner planar surface of the third foot member and the body portion of the thermal insulation strip; and, a fourth concave connection region defined between the fourth partial inner planar surface of the fourth foot member and the body portion of the thermal insulation strip.

14. The thermal insulation strip according to claim 13, wherein:

the third concave connection region is semi-circular and has a radius; and, the fourth concave connection region is semi-circular and has the same radius as the third concave connection region.

15. The thermal insulation strip according to claim 14, wherein:

the third concave connection region subtends an angle of about 90°; and, the fourth concave connection region subtends an angle of about 90°.

16. The thermal insulation strip according to claim 8, wherein:

the central wall portion of the body portion comprises a first base region coupled with the first edge and a second base region coupled with the second edge, wherein the first and second base regions are spaced apart relative to a central region of the wall portion in a direction along the height axis, and wherein the first and second base regions have a thickness in a direction along the transverse axis that is greater than a thickness of the central region of the wall portion in the direction along the transverse axis.

17. The thermal insulation strip according to claim 8, wherein:

the first partial inner planar surface is disposed on a first side of the first head portion;

the second partial inner planar surface is disposed on a second side of the first head portion opposite from the first side of the first head portion; and none of the first or second partial inner planar surfaces overlap the recessed region in directions along the longitudinal axis.

18. The composite frame apparatus according to claim 5, wherein:

the first concave connection region forms a continuous transition between the first inner planar surface and the body portion; and the second concave connection region forms a continuous transition between the second inner planar surface and the body portion.

19. The thermal insulation strip according to claim 8, wherein:

the first concave connection region forms a continuous transition between the body portion of the thermal insulation strip and first partial inner planar surface; and the second concave connection region forms a continuous transition between the body portion of the thermal insulation strip and the second partial inner planar surface.

* * * * *